US007437085B2

(12) United States Patent
Nakagawa et al.

(10) Patent No.: US 7,437,085 B2
(45) Date of Patent: Oct. 14, 2008

(54) FIXING APPARATUS AND IMAGE FORMING APPARATUS

(75) Inventors: Atsushi Nakagawa, Toride (JP); Hidehiko Kinoshita, Kashiwa (JP); Jun Yamaguchi, Toride (JP); Masaaki Moriya, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 11/460,082

(22) Filed: Jul. 26, 2006

(65) Prior Publication Data

US 2007/0025751 A1 Feb. 1, 2007

(30) Foreign Application Priority Data

Jul. 29, 2005 (JP) ..... 2005-221919

(51) Int. Cl.
*G03G 15/20* (2006.01)

(52) U.S. Cl. ..... 399/21; 399/320; 399/328; 399/122; 399/33; 399/68

(58) Field of Classification Search ..... 399/320, 399/328, 322, 329, 330, 335, 336, 33, 67, 399/68, 69, 21, 16, 341, 122; 219/216
See application file for complete search history.

(56) References Cited

U.S. PATENT DOCUMENTS 4,497,569 A * 2/1985 Booth, Sr. ..... 399/20
4,730,204 A * 3/1988 Satoh et al. ..... 399/17
5,678,123 A * 10/1997 Kim ..... 399/21
5,761,567 A * 6/1998 Yoshizuka ..... 399/17
5,933,677 A * 8/1999 Lee ..... 399/20
6,007,918 A * 12/1999 Tan et al. ..... 428/451
6,271,870 B1 * 8/2001 Jacob et al. ..... 347/156
6,374,063 B1 * 4/2002 Todome ..... 399/18
6,539,185 B2 * 3/2003 Hanyu et al. ..... 399/67
6,567,640 B2 * 5/2003 Ishikawa et al. ..... 399/329
6,580,884 B2 * 6/2003 Kuwabara ..... 399/92
6,934,507 B2 * 8/2005 Ohki et al. ..... 399/406
6,985,677 B2 * 1/2006 Yamagata et al. ..... 399/18
7,389,078 B2 * 6/2008 Daishi et al. ..... 399/329

(Continued)

FOREIGN PATENT DOCUMENTS

EP 0 301 585 2/1989

(Continued)

*Primary Examiner*—David M. Gray
*Assistant Examiner*—G. M. Hyder
(74) *Attorney, Agent, or Firm*—Fitzpatrick, Cella, Harper & Scinto

(57) ABSTRACT

A fixing apparatus includes a fixing rotary body; a rotary body provided with an interval from the fixing rotary body; an endless belt rotating in a condition in which it is wound around the fixing rotary body and the rotary body; a pressure rotary body which makes a pressure contact with the fixing roller across the endless belt; a heater for heating a recording material conveyed by the endless belt; a cooling unit for cooling a recording material conveyed by the endless belt and heated by the heater; and an error detecting member for detecting an error in conveyance of the recording material. When an error is detected in the downstream of the cooling unit by the error detecting member, the recording material is stopped after the recording material on the endless belt is conveyed to a position in which the cooling unit cools the recording material.

6 Claims, 10 Drawing Sheets

U.S. PATENT DOCUMENTS

| | | | | |
|---|---|---|---|---|
| 2002/0098022 | A1* | 7/2002 | Kabashima | 399/341 |
| 2004/0091296 | A1* | 5/2004 | Ishizuka et al. | 399/329 |
| 2006/0131301 | A1 | 6/2006 | Ohta et al. | 219/619 |
| 2006/0157475 | A1 | 7/2006 | Nishihara et al. | 219/619 |
| 2007/0053708 | A1* | 3/2007 | Mori et al. | 399/69 |
| 2007/0059057 | A1* | 3/2007 | Kinoshita et al. | 399/322 |
| 2007/0166086 | A1* | 7/2007 | Toyohara et al. | 399/341 |

FOREIGN PATENT DOCUMENTS

| | | |
|---|---|---|
| JP | 64-35452 | 2/1989 |
| JP | 4-362679 | 12/1992 |
| JP | 5-216322 | 8/1993 |
| JP | 5-216580 | 8/1993 |
| JP | 2003-84477 | 3/2003 |

* cited by examiner

FIXING APPARATUS AND IMAGE FORMING APPARATUS

BACKGROUND OF THE INVENTION

1. Field of the Invention

The present invention relates to a fixing apparatus and an image forming apparatus.

2. Description of the Related Art

Requirements for picture quality have been raised to higher and higher level as an image forming apparatus for forming an image on a recording material has been used in a variety of fields. As one of factors which determine the picture quality, particularly, the degree of gloss of full-color image, smoothness of output image can be mentioned.

To meet such a demand, for example, Japanese Patent Application Laid-Open NO. 64-35452 and Japanese Patent Application Laid-Open No. 5-216322 have disclosed an image forming method of forming color images by heating and melting color toner images after the color toner images of thermoplastic resin are transferred to a recording material in which transparent resin layer of thermoplastic resin is formed. As a preferred fixing method of these image forming methods, a belt fixing apparatus has been proposed.

As this belt fixing apparatus, for example, the belt fixing apparatuses described in Japanese Patent Application Laid-Open No. 5-216580 and Japanese Patent Application Laid-Open No. 4-362679 have been known. In the belt fixing apparatuses described in the Japanese Patent Application Laid-Open No. 5-216580 and Japanese Patent Application Laid-Open No. 4-362679, a recording material bearing a non-fixed toner image is pressed and heated with the fixing belt composed of heat resistant film and this recording material is cooled while kept in firm contact with the fixing belt so as to harden the toner image and then, the recording material to which the toner image is fixed is separated from the fixing belt.

As a result, with the toner image buried in transparent resin layer of the recording material, the transparent resin layer and toner image fixed on a surface of the recording material are coagulated along the belt surface configuration and the entire surface of the recording material turns to a smooth one, so as to obtain a color image excellent in the gloss property.

As the recording material having resin layer used in such an image forming apparatus, various recording materials as described in Japanese Patent Application Laid-Open No. 2003-84477 have been proposed. Japanese Patent Application Laid-Open No. 2003-84477 has proposed an electronic photographic transfer sheet in coated with resin layer mainly composed of thermoplastic resin having a glass transition temperature of 85% or less in the thickness of about 10 μm.

However, under the above-described structure, the apparatus is stopped at the same time as detection timing of an error in the apparatus if the error occurs in the downstream of a cooling means. Thus, the recording material before cooling can stop on an endless belt. In the meantime, the fixing apparatus includes art for stopping transportation of recording materials located in the upstream relative to an error position at the same time when the error is detected in that fixing apparatus, such as jamming of the recording material, and discharging recording materials located in the downstream relative to the error position. Even if this art is applied to a conventional structure including the fixing belt, the recording material can stop on the endless belt when any error occurs in the downstream of the fixing apparatus.

The recording material after heating and pressurization adheres to the endless belt strongly until it is cooled so that it is fixed thereto. Thus, if the recording material is left on the endless belt before cooling, it is difficult to remove the recording material left in the fixing apparatus. Further, there is a problem that if the endless belt is damaged or there is left fragments of the recording material not separated within the apparatus, fixing property after an error occurs may drop.

SUMMARY OF THE INVENTION

Accordingly, an object of the present invention is to provide a fixing apparatus capable of improving the performance of removal of residual recording material within the apparatus.

To achieve above-mentioned object, the present invention provides a fixing apparatus comprising:

a fixing rotary body;

a rotary body provided with an interval from the fixing rotary body;

an endless belt rotating in a condition in which it is wound around the fixing rotary body and the rotary body;

a pressure rotary body which makes a pressure contact with the fixing roller across the endless belt;

a heater for heating a recording material conveyed by the endless belt;

a cooling unit for cooling a recording material conveyed by the endless belt and heated by the heater; and an error detecting means for detecting an error in conveyance of the recording material, wherein when an error is detected in the downstream of the cooling unit by the error detecting means, the recording material is stopped after the recording material on the endless belt is conveyed to a position in which the cooling unit cools the recording material.

According to the present invention, there is left no recording material on the endless belt before cooling from which the recording material is hard to separate when the fixing apparatus is stopped even if any error occurs in the fixing apparatus. Therefore, the performance of removal is improved so as to facilitate removal of the recording material.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Figure 1:
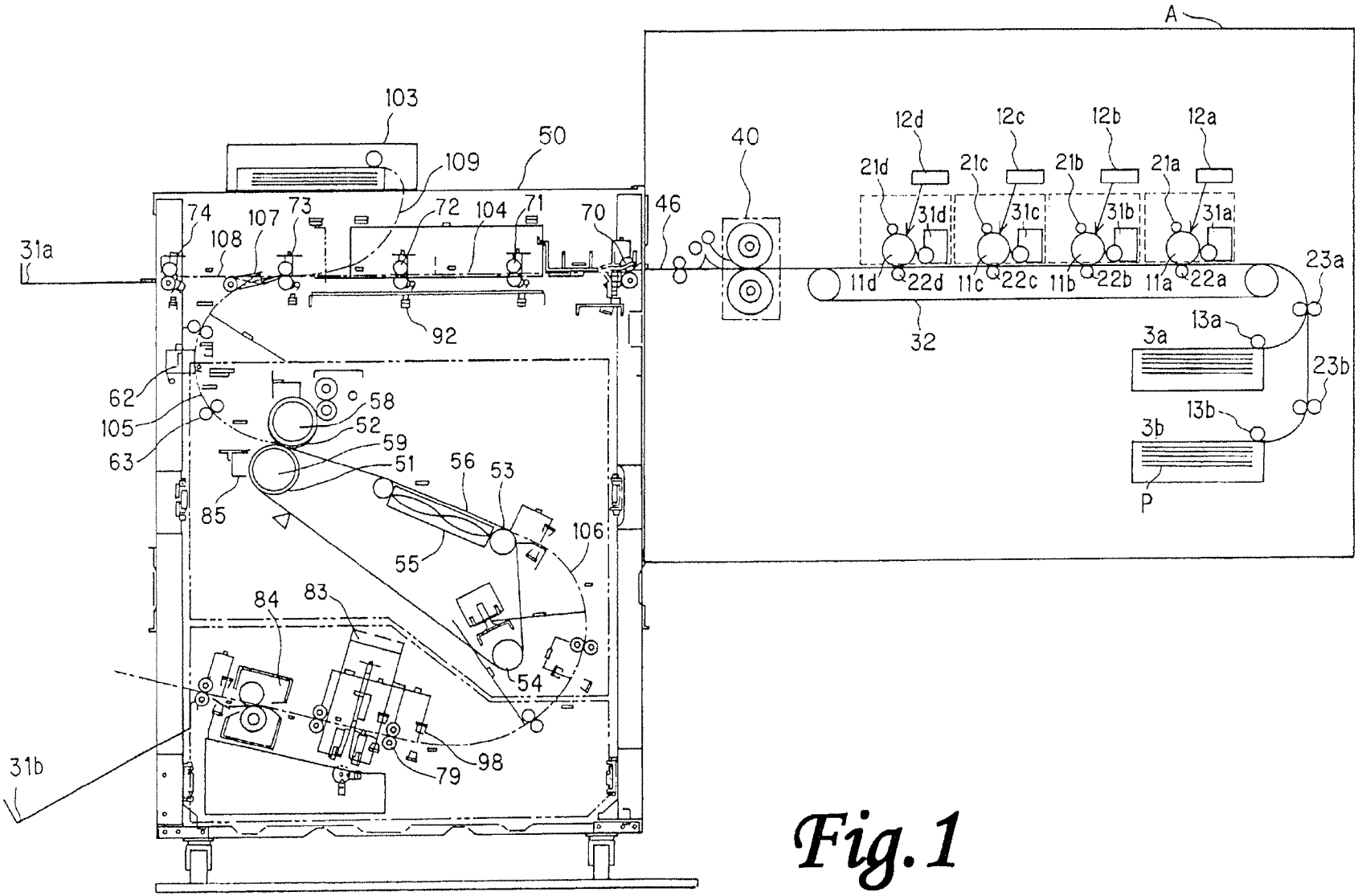
FIG. 1 is a sectional view showing the structure of an image forming apparatus according to an embodiment of the present invention.

Hereinafter, the embodiments of the present invention will be described with reference to the accompanying drawings. In the meantime, like reference numerals are attached to the same components or corresponding ones in all drawings of following embodiments. The dimension, material, shape and relative arrangement of the components described in this embodiment should be changed appropriately depending on the structure of the apparatus to which the invention is applied and various conditions and do not restrict the scope of the present invention to following embodiments.

Hereinafter, one embodiment of the invention will be described with reference to the drawings. In the meantime, like reference numerals are attached to the same components or corresponding ones in all drawings of following embodiment.

FIG. 1 shows an image forming system as an image forming apparatus having a fixing apparatus of the present invention. In the following embodiments, an image forming apparatus A is a tandem type color image forming apparatus which transfers a toner image on the recording material.

This image forming apparatus transfers toner images onto the recording material P successively in each color station so as to obtain a toner image. That is, as an image forming means, transfer units for forming four colors of black BK, cyan C, magenta M and yellow Y on the recording material P are provided. These transfer units include photosensitive drums 11*a* to 11*d*, exposure units 12*a* to 12*d*, chargers 21*a* to 21*d*, development units 31*a* to 31*d* and transfer rollers 22*a* to 22*d*. The recording materials P on which an image is to be formed are stacked and stored in cassettes 3*a*, 3*b* and picked up by pickup rollers 13*a*, 13*b* and conveyed onto an endless transfer belt 32 by conveyance rollers 23*a*, 23*b*.

The toner image formed on the recording material P is fixed by a fixing portion 40 as a fixing means within the image forming apparatus. This image recording apparatus can be set to mode A (plain paper recording mode) and mode B (photography mode).

(mode A (Plain Paper Recording Mode))

Under mode A, the recording material P stored in a paper feed unit (for example, 81 g plain papers) is fed from the paper feed unit and a toner image is transferred and the toner image is fixed on the recording material P by the fixing portion 40. After that, the recording material P passes a conveyance passage 46 and is conveyed to the fixing apparatus 50. The recording material P is conveyed successively through a conveyance passage 104 as a common passage by conveyance rollers 70, 71, 72, 73. The recording material P is changed over by a flapper 107 as a changing means after it passes and conveyed through a conveyance passage 108 as a second passage and discharged to an discharge tray 31*a* by a discharge roller 74.

(mode B (Photography Mode))

On the other hand, under mode B, the recording material P stored in the paper feed unit is supplied and a toner image is transferred while the paper passes the fixing portion 40. After that, the recording material P passes through the conveyance passage 46 and is conveyed to the fixing apparatus 50. The recording material P is conveyed through the conveyance passage 104 successively by the conveyance rollers 70, 71, 72, 73 and the passage is changed over by the flapper 107 so that the recording material P is conveyed to a conveyance passage 105 side which is part of the first passage. After that, fixing processing is carried out by the fixing belt 56 which is an endless belt. Subsequently, the recording material P is conveyed through a conveyance passage 106 which is part of the first passage and a predetermined processing is carried out by cutters 83, 84 successively and cut papers are discharged to the discharge tray 31*b*.

Figure 2:
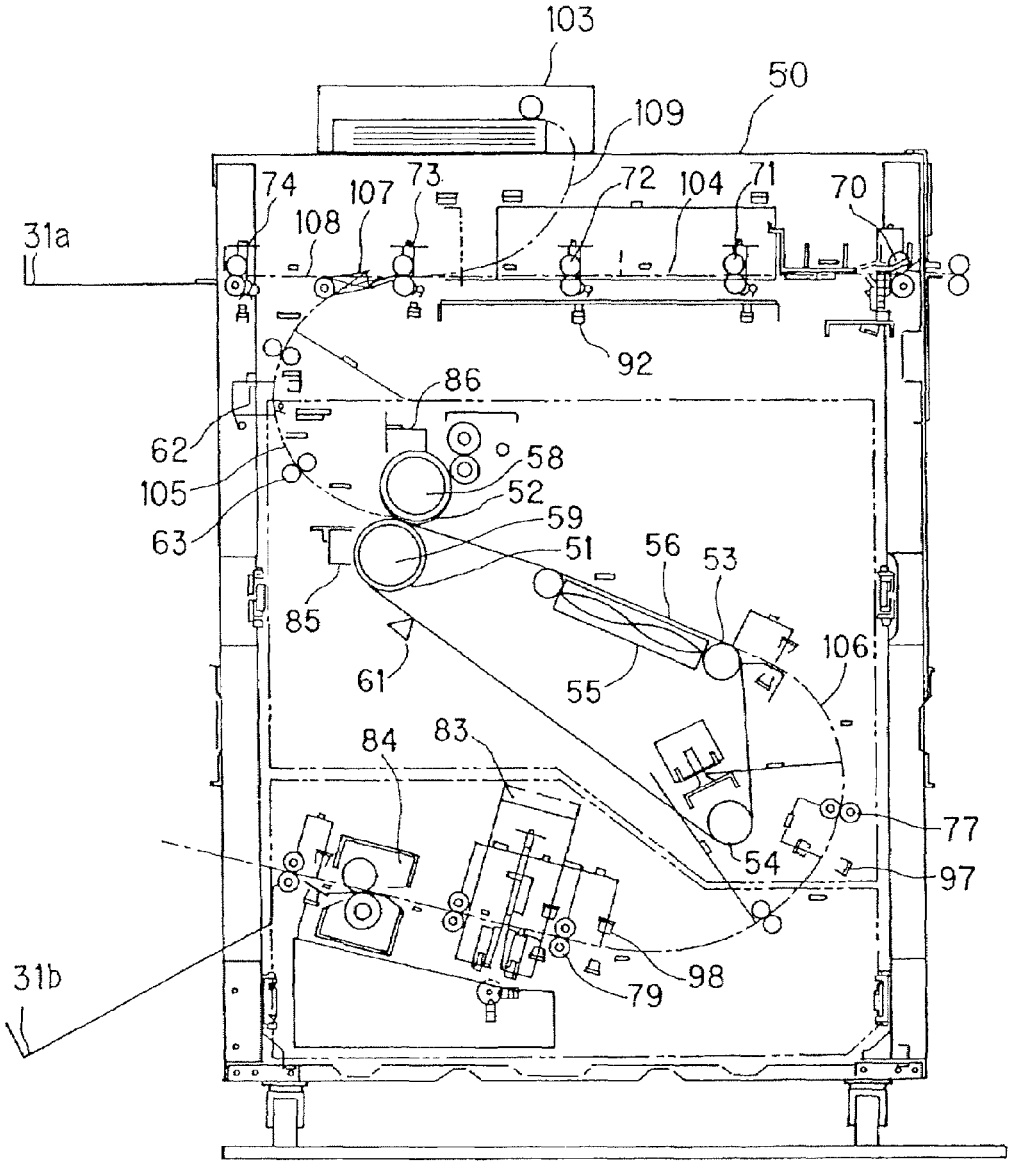
FIG. 2 is a sectional view showing the structure of a fixing apparatus according to an embodiment of the present invention.

FIG. 2 shows a fixing apparatus according to an embodiment of the present invention. As shown in FIG. 2, the fixing apparatus comprises a fixing roller 51 as a fixing rotary body, a pressure roller 52 as a pressurization rotary body, a rotary roller 53 provided at an interval from the fixing roller 51, a tension roller 54 and a cooling fan 55 as a cooling device. The fixing apparatus further includes a fixing belt 56 which is an endless belt stretched among the fixing roller 51, the rotary roller 53 and the tension roller 54. The fixing apparatus includes a sensor 61 for detecting the position of a recording material P on the fixing belt 56, a TOP sensor 62 for detecting the front end of the recording material P and a resist roller pair 63.

Roller heaters 59, 58, which are heaters for heating the recording material, are disposed within the fixing roller 51 and the pressure roller 52 respectively. These roller heaters 58, 59 are controlled in temperature by temperature sensors 85, 86, which are composed of a thermistor.

The fixing roller 51 is constituted of concentric three layers. The three layer structure includes a core portion, an elastic layer and a separation layer. The core portion of these is constituted of an aluminum made hollow pipe of 44 mm in diameter and 5 mm in thickness. In the meantime, a halogen lamp is disposed as a heat source within the hollow pipe of the core portion. The elastic layer is composed of silicone rubber having JIS-A hardness of 50 degrees and a thickness of 3 mm. The separation layer is composed of PFA of 50 μm in thickness. The pressure roller 52 adopts the same structure.

The fixing belt 56 is constituted of two layer structure in which a mirror-like separation layer is provided on a face (first surface) which makes contact with the recording material P or the pressure roller 52 and a base material is provided on a face (second surface) which makes contact with the fixing roller 51. The separation layer of these is constituted of PFA of 10 μm in thickness. The base material is constituted of an endless belt of stainless sheet of 100 μm in thickness.

The cooling fan 55 in a cooling area is provided inside the fixing belt 56. Air flow is blown in the direction perpendicular to the paper surface of the recording material P by the cooling fan 55.

The fixing belt 56 is supplied with a predetermined tension by the tension roller 54. When the fixing roller 51 is driven in rotation in the right direction in FIG. 2, this fixing belt 56 is rotated. As a result, the curvature of the fixing belt 56 at the cooling section is maintained at a substantially constant curvature by stiffness of the fixing belt 56 itself.

The roller heaters 58, 59 constituted of halogen lamps disposed within each of the fixing roller 51 and the pressure roller 52 are supplied with electric power. Consequently, the surface temperatures of the fixing roller 51 and the pressure roller 52 are raised.

Next, the recording material P will be described. That is, the recording material for use in this embodiment is comprised of base material having pigment coating layer on at least one surface and resin layer provided on the pigment coating layer. The pigment coating layer is composed of mainly adhesive agent and pigment and the resin layer is composed of mainly thermoplastic resin.

Although this resin layer includes thermoplastic resin and thermosetting resin as its main component, it may be mixed resin layer which is mixed with thermoplastic resin and thermosetting resin. Further, the resin layer may be constituted of a plurality of layers including thermoplastic resin layer composed of mainly thermoplastic resin and thermosetting resin layer composed of mainly thermosetting resin.

When the resin layer is constituted of a plurality of layers, it is preferable to provide the thermosetting resin layer composed of mainly thermosetting resin on the topmost layer. Further, the resin layer may be constructed by combining the mixed resin layer, the thermoplastic resin layer and the thermosetting resin layer. In this case, the topmost layer is preferred to be composed of a layer including thermosetting resin, such as the mixed resin layer and the thermosetting resin layer. The thermoplastic resin includes polyester resin, styrene-acrylic acid ester and styrene-methacrylate ester and particularly, it is preferable to use polyester resin.

Control of the Fixing Apparatus

Figure 3:
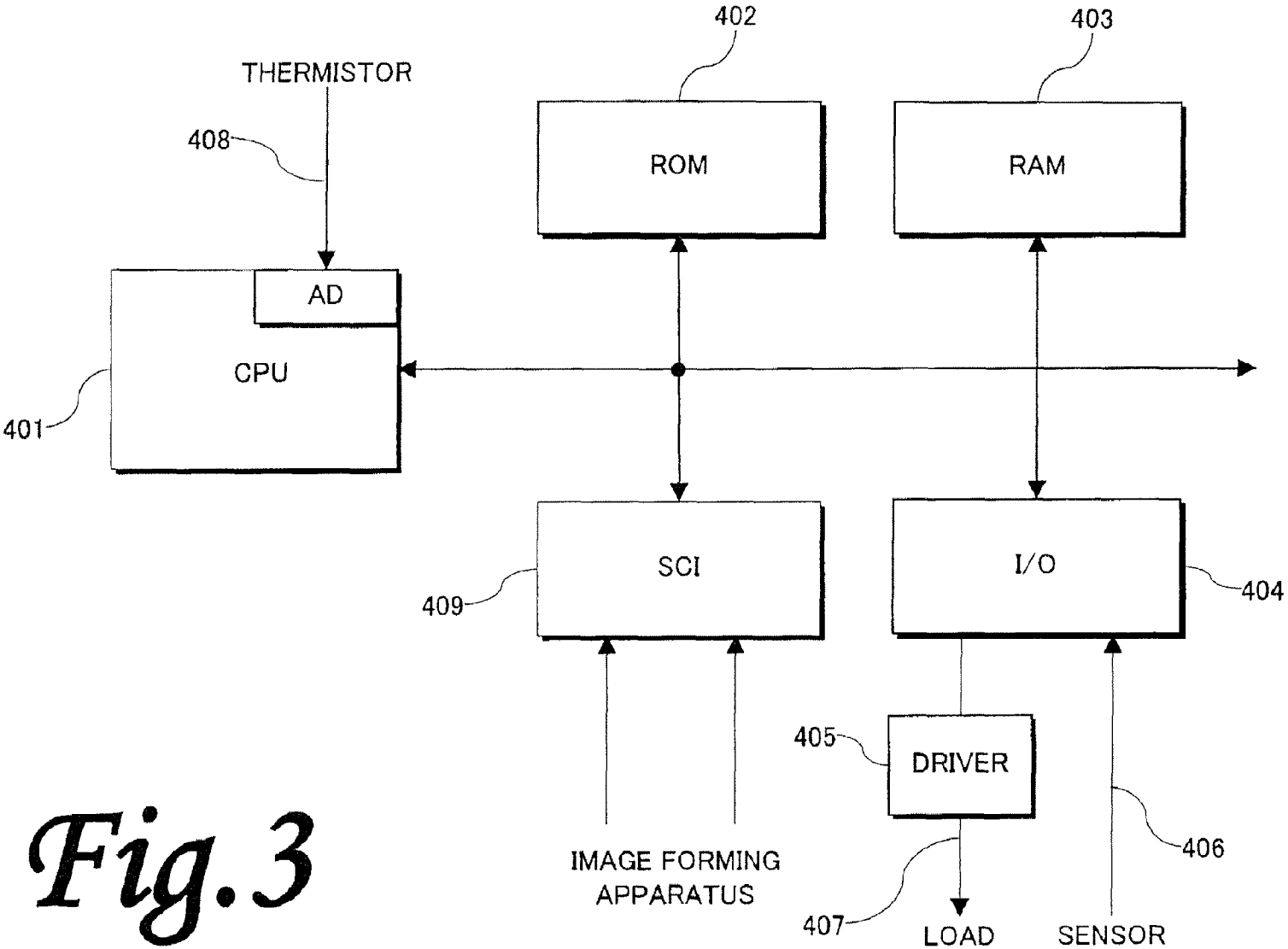
FIG. 3 is a block diagram showing the structure of a controller for controlling the fixing apparatus in this image forming system.

Next, control of the fixing apparatus of this embodiment will be described. FIG 3 shows a controller for controlling the fixing apparatus 50 of this embodiment. In FIG. 3, the CPU 401 is a processing circuit for executing mechanical control of the fixing apparatus 50 and executes control following a program stored in the ROM 402. According to this embodiment, an error detecting means capable of detecting an error such as a conveyance error is constituted of various sensors and this controller. That is, a RAM 403 is a rewritable memory means for used by the CPU 401 and various sensors 406 are read into the CPU 401 via an I/O port 404. The various sensors 406 include a sensor as a position detecting means for detecting whether or not there is a transfer paper as a recording material and the position of the recording material. The control portion constituted of the CPU 401, the ROM 402 and the RAM 403 or the like is provided on the fixing apparatus 50.

The I/O port 404 is connected to a driver 405. An output of the I/O port 404 is converted to a necessary drive voltage and supplied to various loads 407. Each load 407 includes a heater, a paper feeding motor for driving the conveyance roller, a motor, clutch and solenoid for cutting the recording material P. Further, the load 407 includes the fixing roller 51 and a motor for rotating the fixing belt 56 by driving the rotary roller 53. Serial communication interface 409 (SCI) is an interface which executes transmission/receiving of information between the CPU 401 and a controller (not shown) in the image forming apparatus A.

The temperature sensors 85, 86 (see FIGS. 2, 1) for detecting the temperatures of the fixing roller 51 and the pressure roller 52 respectively in the fixing apparatus 50 are connected to A/D input of the CPU 401. The CPU 401 controls the fixing heater corresponding to temperature data detected by the temperature sensors 85, 86 connected to the A/D input. In the meantime, the CPU 401, the ROM 402 and the RAM 403 may be provided in the image forming apparatus A.

Image Forming Operation

Next, the image forming operation at normal time of the fixing apparatus according to an embodiment will be described.

First, the recording material P output from the image forming apparatus A is conveyed to the fixing apparatus 50. The recording material P is conveyed through the conveyance passage 104 successively by the conveyance rollers 70, 71, 72, 73. The recording material P after passing the conveyance passage 104 is conveyed to the conveyance passage 105 following a selection by the flapper 107. After that, the recording material P passes the sensor 62 and is stopped when its front end is nipped by the resist roller pair 63. In the meantime, the rotation of the fixing belt 56 is continued.

A desired position of the fixing belt is detected by the sensor 61 and the resist roller pair 63 starts rotation again by synchronizing a timing when a recording material bonding position HT on the fixing belt 56 reaches a nipping position between the fixing roller 51, the fixing belt 56 and the pressure roller 52 with a timing when the topmost end of the recording material P reaches a fixing nip portion and then, the recording material P is conveyed into the fixing nip portion.

Figure 4B:
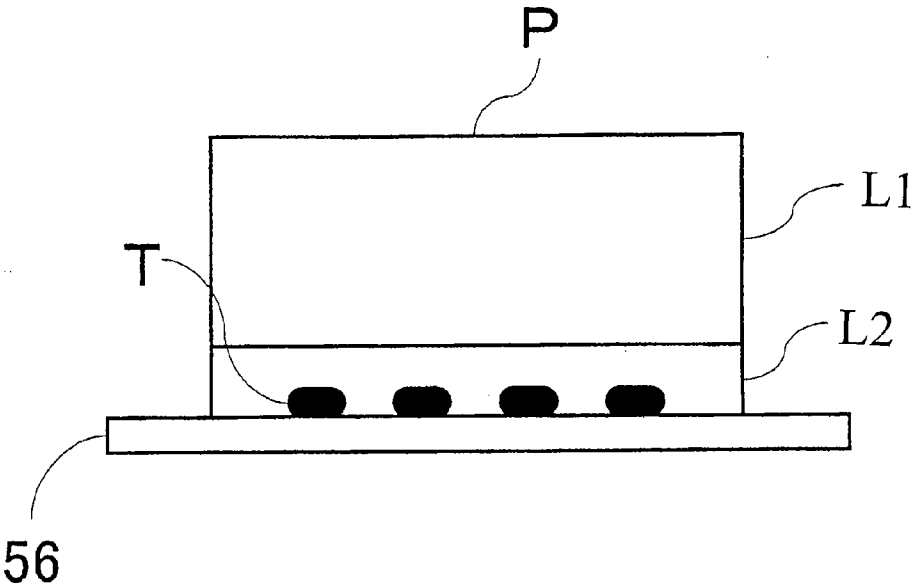
FIG. 4B is a diagram showing the condition of toner on the recording material P after it passes a second fixing portion in this image forming system.
Figure 4A:
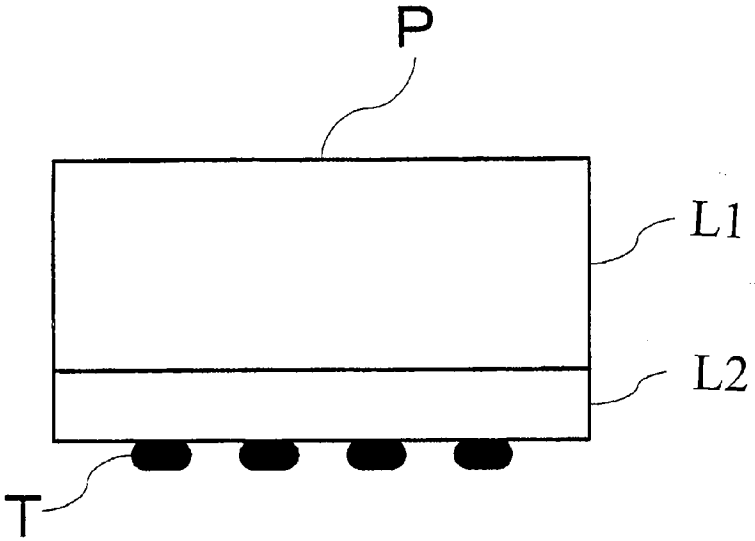
FIG. 4A is a diagram showing the condition of toner applied on the recording material P after it passes a first fixing portion of this image forming system.

After that, the recording material P passes a pressure contact portion between the fixing belt 56 and the pressure belt 52. At this time, heat from the fixing roller 51 and the pressure roller 52 is added to the recording material P and toner T on the recording material P. Thus, the temperature of the transparent resin layer L2 within the recording material P is raised so that it is softened and further, pressures by the fixing roller 51 and the pressure roller 52 are added. As a result, toner image in a condition as shown in FIG. 4A before it passes the pressure contact portion is buried into the transparent resin layer L2 having a high temperature on the recording material P as shown in FIG. 4B. At the same time, the recording material P adheres to the surface of the fixing belt 56.

After that, the recording material P is conveyed into the cooling area with a rotation of the fixing belt 56 in a condition in which it adheres to the fixing belt 56. The recording material P is cooled compulsorily and effectively in the cooling area by an action of the cooling fan and air flow within an air duct surrounding the cooling fan 55.

Figure 5:
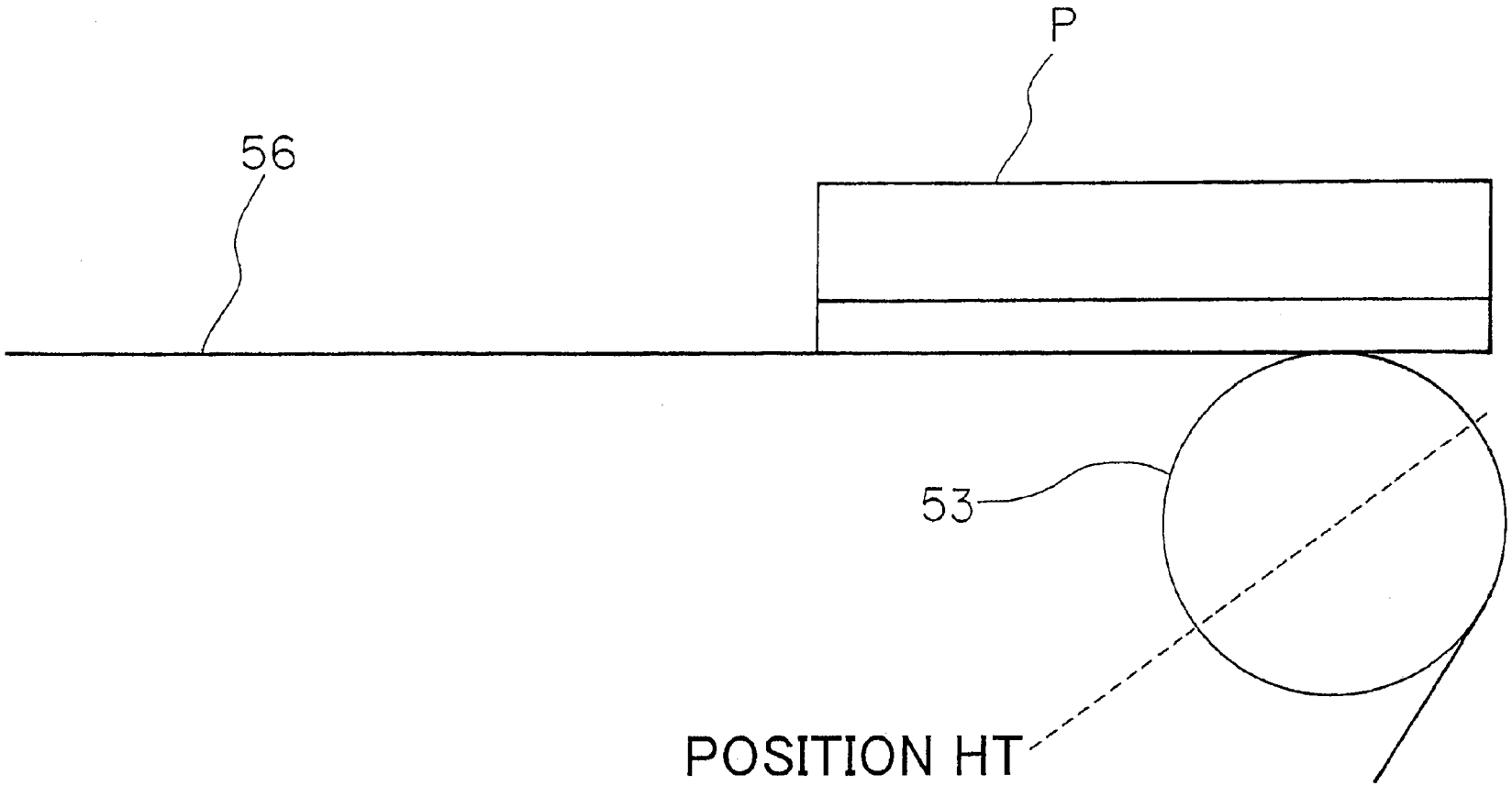
FIG. 5 is a diagram showing timing of bonding the recording material on the fixing belt according to an embodiment of the present invention.

The recording material P adhering to the surface of the fixing belt 56 is thus cooled in the cooling area of the cooling fan 55. Then, as shown in FIG. 5, separation of the recording material P from the fixing belt 56 is started from a front portion of the recording material P due to stiffness, i.e. "rigidity", of the recording material P itself at a position in which the curvature of the fixing belt 56 is changed by the rotary roller 53. In FIG. 5, the recording material P is separated from the position HT on the rotary roller 53 and the fixing belt 56.

As shown in FIG. 1, the separated recording material P passes the conveyance passage 106 and is cut by the cutters 83, 84. The recording material P is cut to have cutting widths WT, WY shorter than margin width in terms of vertical and horizontal ends. After that, the recording material P is conveyed to the discharge tray 31*b*.

Image Forming Operation

Figure 6:
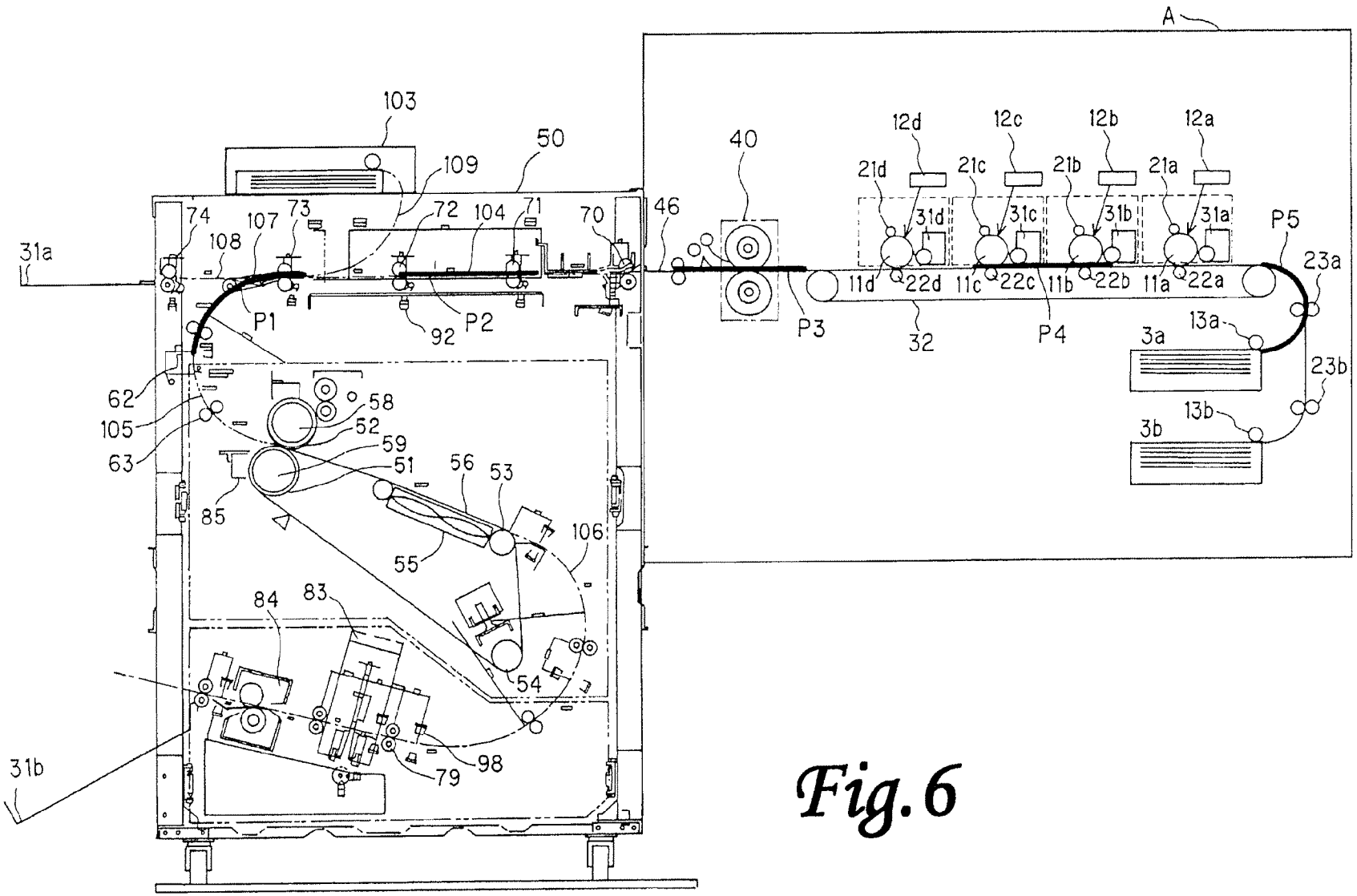
FIG. 6 is a diagram showing conveyance sequence of the recording material at a normal time in the image forming apparatus according to an embodiment of the present invention.

Next, a series of continuous operation at normal time of the image forming system according to the embodiment will be described. Here, an image output under photography mode having continuous five pieces will be described. FIG. 6 shows a conveyance condition of the recording material P within the image forming apparatus according to the embodiment.

As shown in FIG. 6, a first sheet P1 in which an image is formed by the image forming apparatus A is stopped temporarily at the sensor 62 after it passes the conveyance passages 104, 105 based on a predetermined recording material conveyance sequence. At this time, a second sheet P2 is detected by the sensor 92 and stopped at a position which it is nipped by the conveyance roller 72.

At this time, a third sheet P3 passes the fixing portion 40 of the image forming apparatus A. Further, the image forming operation is executed on a fourth sheet P4 on the transfer belt and a fifth sheet P5 is located at a position in which it is supplied from the paper feeding portion. Then, the desired position of the fixing belt is detected by the sensor 61 for the first sheet P1 and the resist roller pair 63 are started to rotation by synchronizing a timing when the recording material bonding position HT on the fixing belt 56 reaches the nipping portion (fixing nipping portion) between the fixing roller 51, the fixing belt 56 and the pressure roller 52 with a timing when the topmost end portion of the first sheet P1 reaches the fixing nipping portion. As a consequence, the first sheet is conveyed into the fixing nipping portion.

After that, the first sheet P1 passes the pressure contact portion between the fixing belt 56 and the pressure roller 52. At this time, the first sheet P1 and toner T on the first sheet P1 are heated by the fixing roller 51 and the pressure roller 52. Thus, the temperature of the transparent resin layer L2 of the first sheet P1 rises so that it is softened and pressures of the fixing roller 51 and the pressure roller 52 are added thereto. As a result, a toner image in the condition shown in FIG. 4A before it passes the pressure contact portion is buried in the transparent resin layer L2 having a high temperature on the first sheet P1 as shown in FIG. 4B. At the same time, the first sheet P1 is bonded to the surface of the fixing belt 56.

The first sheet P1 is conveyed through the cooling area with a rotation of the fixing belt 56 in a condition in which it adheres to the fixing belt 56. The first sheet P1 is cooled compulsorily and effectively by an action of air flow within the cooling fan 55 and the air duct (not shown) surrounding the cooling fan 55. In the meantime, the cooling fan 55 is so constructed to be capable of changing the flow rate of the air flow. Consequently, a flow rate of the air flow which allows the recording material P on the fixing belt 56 to be separated easily can be set up.

The first sheet P1 adhering to the surface of the fixing belt 56 is cooled sufficiently in the cooling area. The first sheet P1 is separated by its own stiffness (rigidity) from the surface of the fixing belt 56 in an area in which the curvature of the fixing belt 56 is changed by the rotary roller 53.

As shown in FIGS. 5 and 6, separation of the first sheet P1 after conveyed by the fixing belt 56 in a condition in which it adheres thereto begins from its front end by the stiffness (rigidity) of the first sheet P1 itself when it reaches the position HT in which the curvature of the fixing belt 56 is changed by the rotary roller 53.

Figure 7:
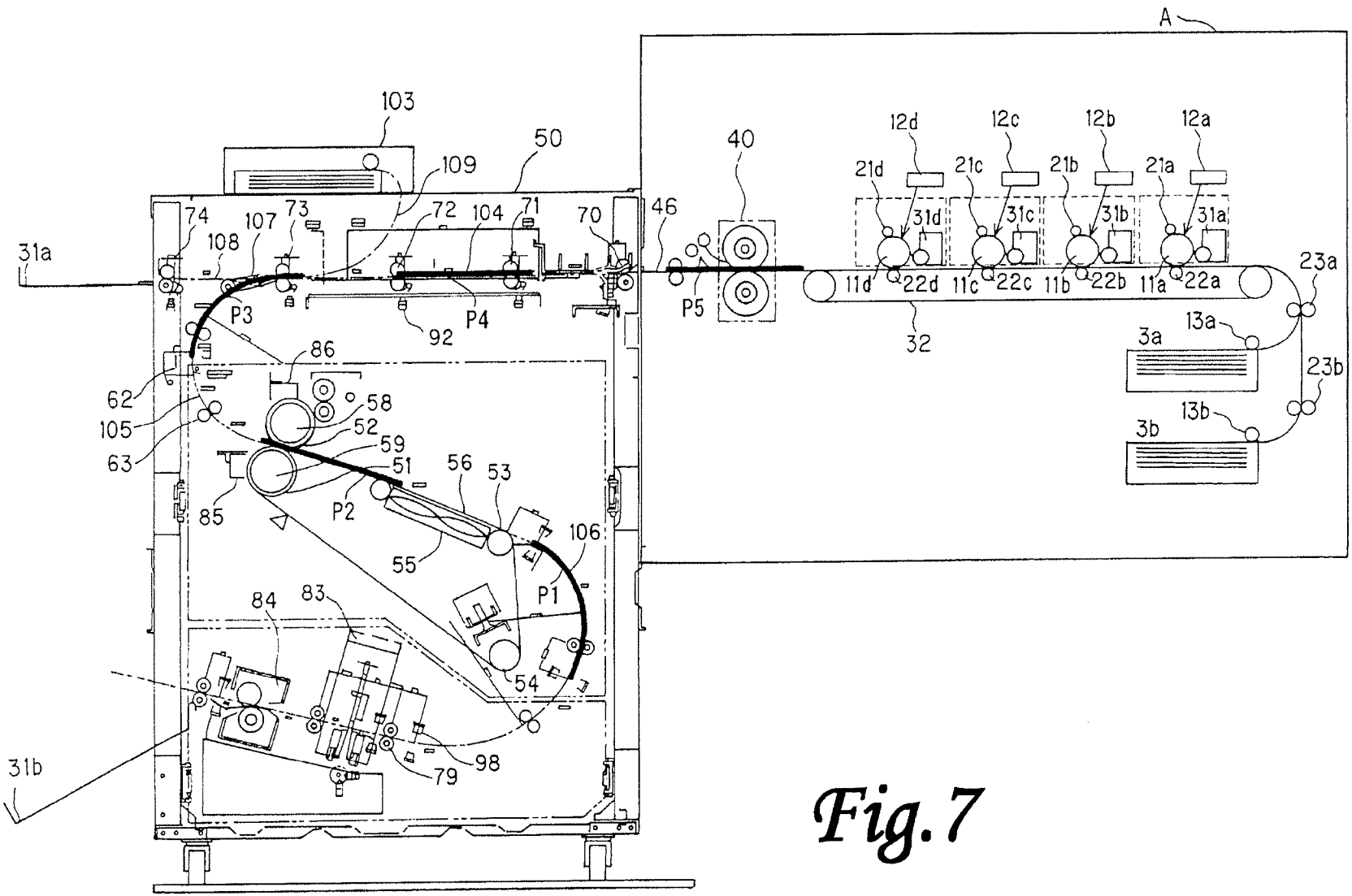
FIG. 7 is a diagram showing a conveyance sequence of the recording material at the normal time in the image forming apparatus according to an embodiment of the present invention.

As shown in FIG. 7, the first sheet P1 separated from the fixing belt 56 is conveyed by the conveyance roller 77 within the conveyance passage 106 and passes a recording material sensor 97. At this time, the second sheet P2 is conveyed on the fixing belt 56 so that a toner image formed on the surface is buried into the resin layer. The third sheet P3 is detected by the sensor 62 and stopped temporarily. The fourth sheet P4 is detected by the sensor 92 and stopped at a position in which it is nipped by the conveyance roller 72. The fifth sheet P5 passes the fixing portion 40 of the image forming apparatus A.

Figure 8:
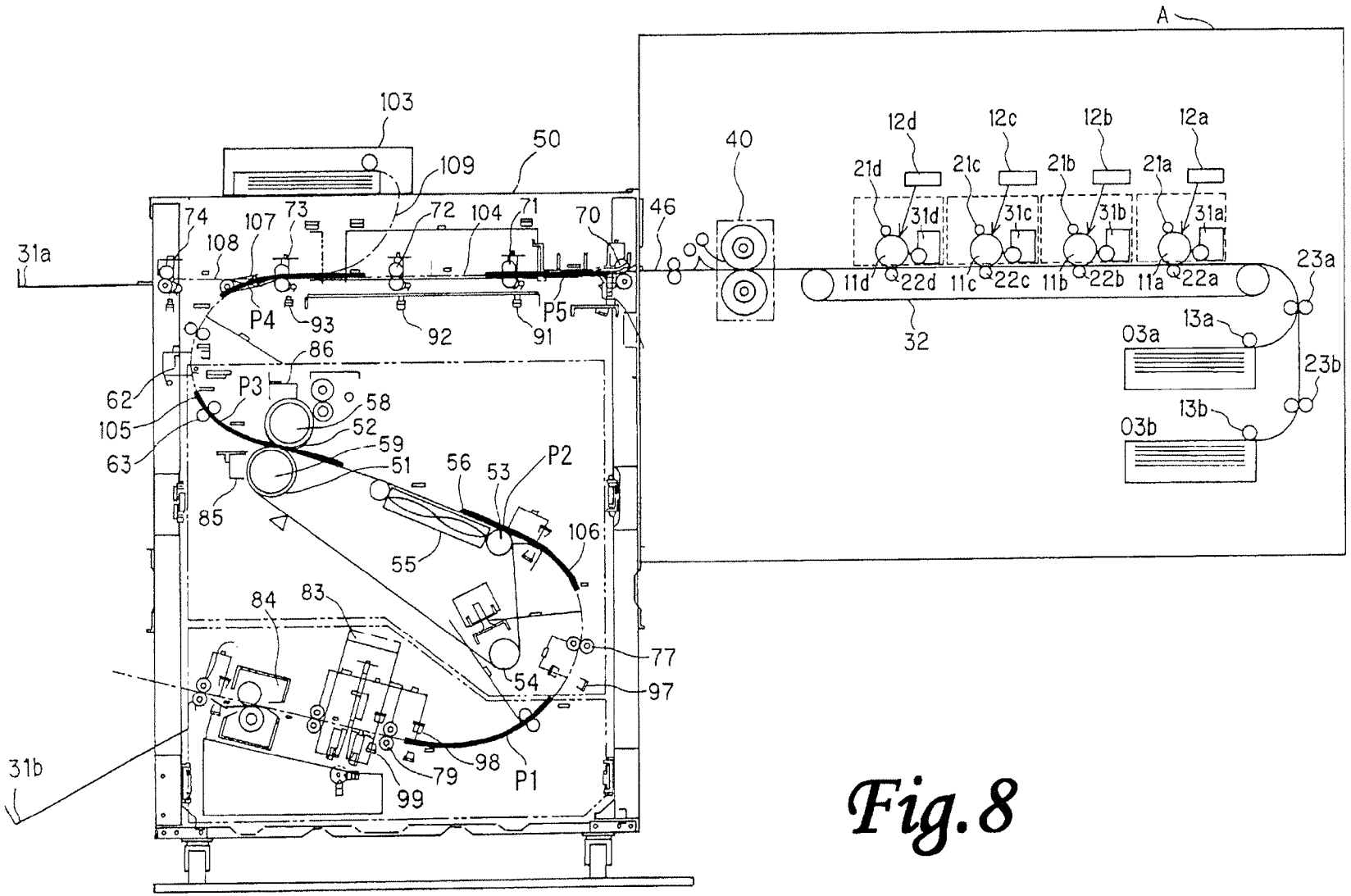
FIG. 8 is a diagram showing the conveyance sequence of the recording material at the normal time in the image forming apparatus according to an embodiment of the present invention.

After that, as shown in FIG. 8, the first sheet P1 is conveyed by the conveyance roller 78 up to a before-cutter-registration sensor 98 and nipped by the conveyance roller 79 and stopped temporarily. At this time, the second sheet P2 is separated from the fixing belt 56 and passes the conveyance passage 106. The third sheet P3 is conveyed on the fixing belt 56 at a predetermined timing and the toner image is buried in the resin layer like the first sheet P1 and the second sheet P2 preceding. The fourth sheet P4 passes the flapper 107. Further, the fifth sheet P5 passes the conveyance passage 104.

Subsequently, the first sheet P1 is conveyed to the cutter registration sensor 99 and cut out by the cutters 83, 84 based on a predetermined sequence. The vertical and horizontal ends of the first sheet P1 are cut at the cutting widths WT, WY shorter than the margin width of the first sheet P1 and the cut sheets are discharged to the discharge tray 31*b* by a conveyance roller 82. The same cutting treatment as the first sheet P1 is carried out on following second sheet P2 to fifth sheet P5 and they are discharged to the discharge tray 31*b*.

The conveyance speed of the recording material by the fixing belt 56 is slower than the conveyance speed by the conveyance rollers 77, 78, 79, 82 provided in the downstream of the cooling means.

Operation When an Error Occurs

Next, a series of continuous operations when an error occurs of the image forming apparatus according to this embodiment will be described. This embodiment will be described by exemplifying a case where images are output under photography mode of continuous five pieces of photos.

Figure 9:
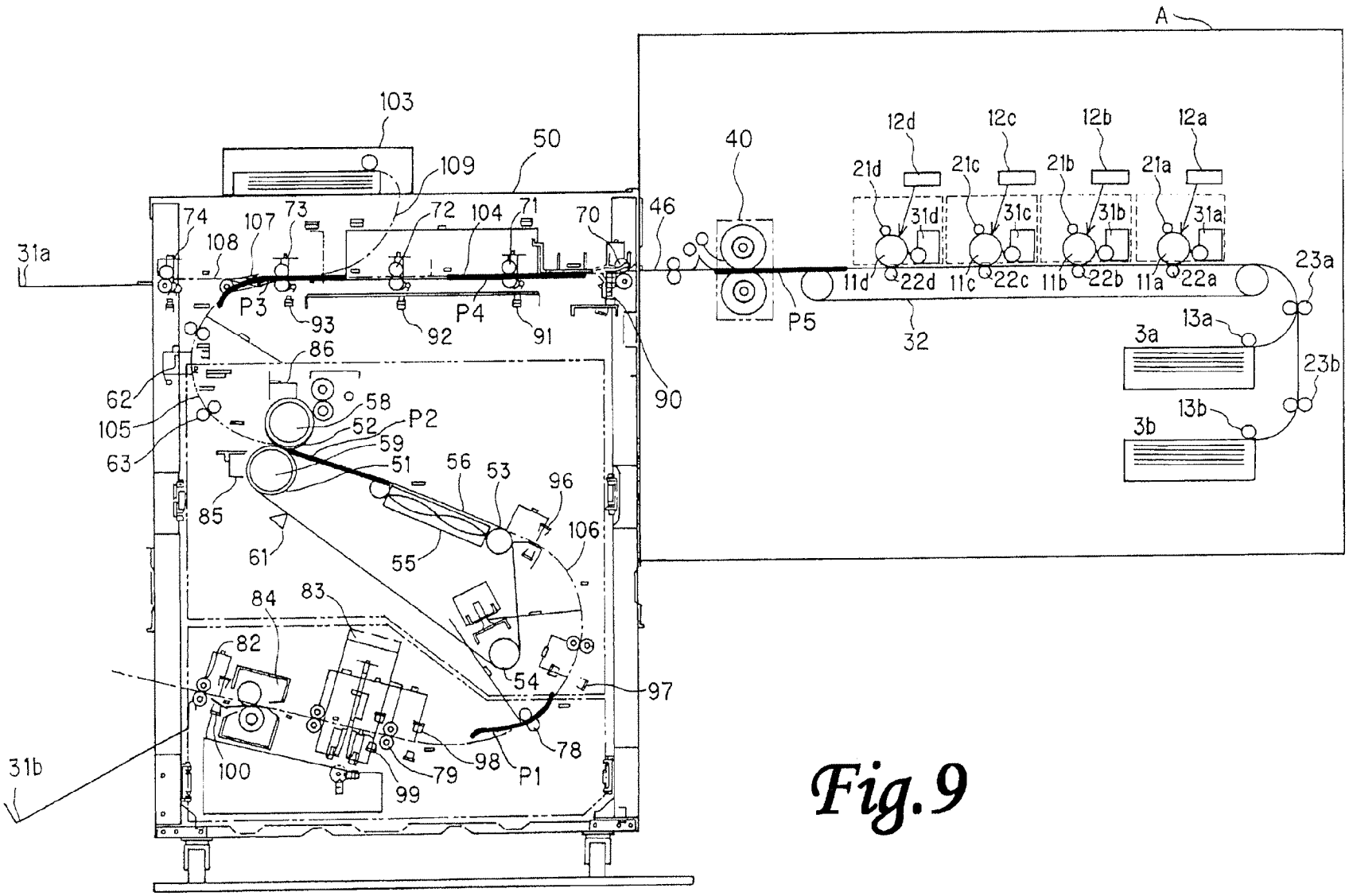
FIG. 9 is a sectional view of the structure of an image forming apparatus system when an error occurs according to an embodiment of the present invention.

As shown in FIG. 9, photo sensors 90, 91, 92, 62, 96, 97, 98, 99, 100 are disposed in order from the upstream of conveyance as part of the configuration of the error detecting means at a position opposing the recording material conveyance passage. The photo sensors 62 to 100 are recording material sensors which detect whether or not there exists any recording material at each position in the recording material conveyance passage provided with the photo sensors. A signal from the photo sensors 62 to 100 is transmitted to the CPU 401 through the I/O port 404. For example, whether or not a timing from a front end to another front end of the recording material is within a predetermined interval is monitored based on a signal from the photo sensors 62 to 100. That is, the error detecting means comprises the photo sensors 62 to 100 and a control portion (controller) such as the CPU 401 for judging an error in conveyance of the recording material based on a signal from the photo sensors 62 to 100.

More specifically, unless after a photo sensor detects a passage of the recording material, a photo sensor located one step down in the downstream with respect to that photo sensor detects the front end of the recording material within a predetermined time period, it is regarded that a delay jam (delay JAM) occurs so as to carry out an error treatment. Similarly, even if the recording material P is left within the fixing apparatus when the fixing apparatus is powered on, the same processing as described below is carried out.

If a recording material detection time by the photo sensors 62 to 100 for detecting the recording material P is longer than a predetermined time, error treatment is carried out as a holding jam (holding JAM). As shown in FIG. 9, it is assumed that after the first sheet P1 for which the image forming processing is carried out by the image forming apparatus A is detected by the sensor 97, a conveyance error occurs during conveyance of the first sheet P1 and it is not detected by the sensor 98 located one step down in the downstream within a predetermined time period. That is, it is assumed that paper jamming occurs in a bending path after fixing through the conveyance passages 104, 105, 106 are passed. In this case, if a delay jam error is detected by the sensor 98, conveyances of the first sheet P1, third sheet P3 and fourth sheet P4 within the fixing portion and the fifth sheet P5 within the image forming apparatus main body are stopped and temperature adjustment operation is also stopped.

Contrary to this, the cooling operation of the cooling fan 55 and conveyance of the second sheet P2 on the fixing belt 56 are continued. Conveyance of the second sheet P2 is stopped a predetermined time after the second sheet P2 is conveyed from the resist roller pair 63 so that the resist turns on or at a timing based on detection of a recording material by the separation sensor 96 and the cooling fan 55 is stopped. The predetermined time after the second sheet P2 is conveyed from the resist roller pair 63 so that the resist turns on or the timing based on detection of the recording material by the separation sensor 96 refers to a period after the second sheet P2 is conveyed to the cooling position by the cooling fan 55.

Paper jam and an instruction for removing it are indicated on the display portion (not shown) of the image forming apparatus so as to urge user for the execution. Even if the recording material P is left within the fixing apparatus when the fixing apparatus is powered on, the recording material P is conveyed up to the position of the cooling fan 55. Consequently, not only processing of keeping out a recording material from the endless belt before cooling is enabled reliably but also processing of keeping out any recording material from the endless belt before cooling is enabled even if the apparatus is stopped.

Continuous Operation When An Error Occurs

Figure 10:
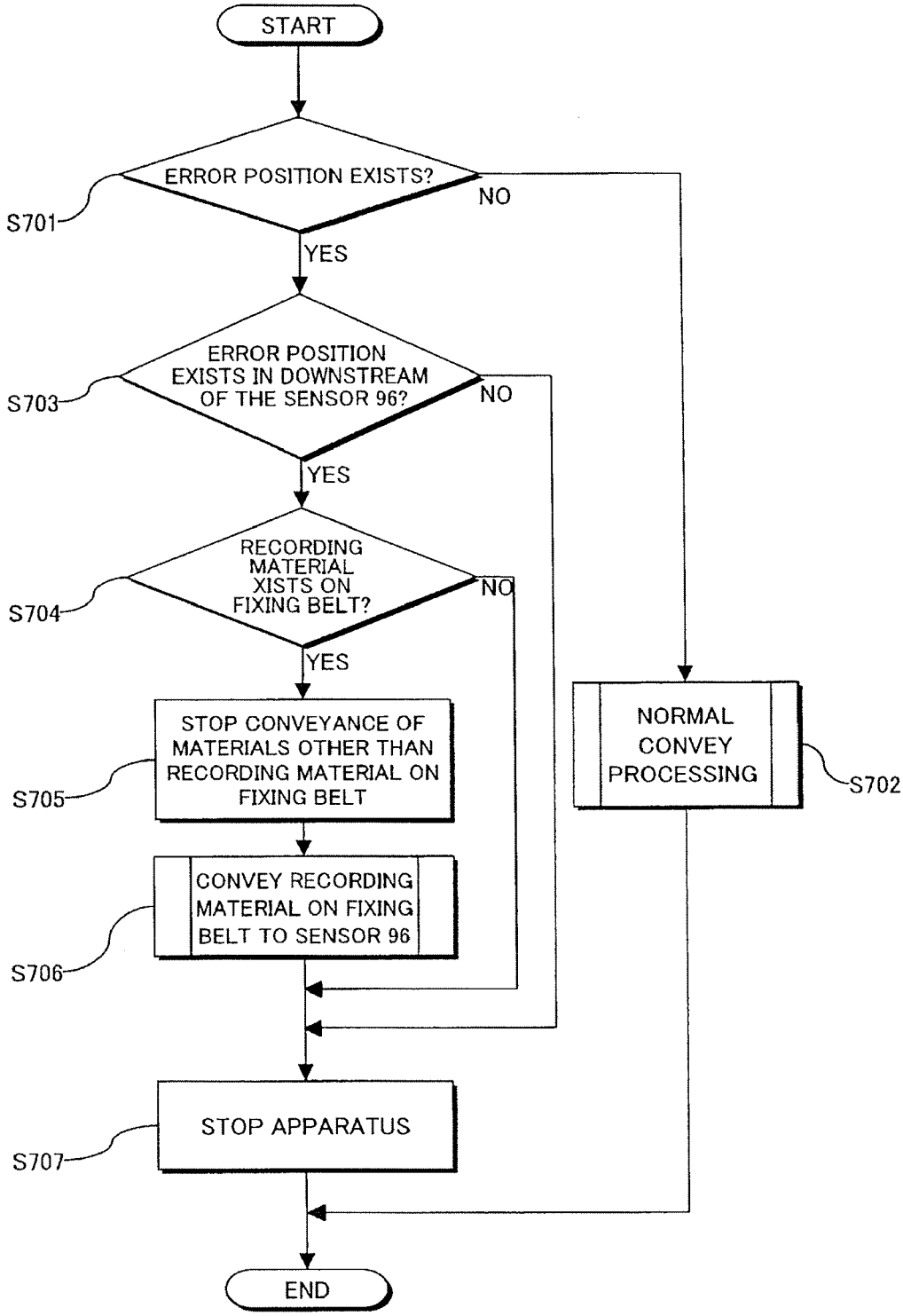
FIG. 10 is a flow chart of an embodiment of the present invention.

Next, a series of the continuous operations when an error occurs of the image forming apparatus according to this embodiment will be described. FIG. 10 shows a flow chart of the continuous operation of this embodiment.

First, in step S701, whether or not the interior of the apparatus is full of paper scraps cut by the cutters 83, 84 or the aforementioned errors such as delay jam or holding jam is generated is monitored by the CPU 401 at a predetermined interval. If the CPU 401 determines that the interior of the apparatus is not full of the paper scraps or no error such as delay jam or holding jam exists in step S701 (S701: NO), the procedure proceeds to step S702, in which the CPU 401 controls to continue the above-described normal conveyance processing.

On the other hand, if the CPU 401 determines that an error occurs in step S701 (S701: YES), the procedure proceeds to step S703. In step S703, whether or not a detected error position is in the downstream of the separation sensor 96 (see FIG. 9), that is, whether or not it is in the downstream of the cooling fan 55 is determined by the CPU 401. That is, according to this embodiment, whether or not the error position exists in the downstream of the cooling fan 55 is determined depending on whether or not the error position is in the downstream of the sensor 96. If it is determined that the error detection position is in the upstream of the sensor 96 by the CPU 401 (S703: NO), the procedure proceeds to step S707, in which the CPU 401 controls to stop the fixing apparatus. On the other hand, if the CPU 401 determines that the error detection position is located in the downstream of the sensor 96 (S703: YES), the procedure proceeds to step S704, in which the CPU 401 determines whether a recording material being conveyed exists on the fixing belt 56.

If the CPU 401 determines that no recording material P exists on the fixing belt 56 in step S704 (S704: NO), the procedure proceeds to step S707, in which the CPU 401 controls to stop the image forming apparatus. On the other hand, if the CPU 401 determines that a recording material exists on the fixing belt 56 in step S704 (S704: YES), the procedure proceeds to step S705.

In step S705, the CPU 401 controls to stop conveyance operation other than for the recording material P existing on the fixing belt 56. The recording material P on the fixing belt 56 is conveyed up to a position which enables the recording material P to secure a sufficient cooling effect by the cooling fan 55. According to this embodiment, after the recording material P on the fixing belt 56 is detected by the sensor 96, the CPU 401 controls to stop the conveyance of the recording material and subsequently, the procedure proceeds to step S707, in which the CPU 401 stops the fixing apparatus.

The above-described embodiment indicates an example in which the apparatus is stopped when the error detection position is in the upstream of the sensor 96. However, when the recording material exists on the fixing belt 56 even if the error detection position is in the upstream of the sensor 96, the recording material on the fixing belt 56 may be controlled to be conveyed at least up to the sensor 96. If the error detection position is in the upstream of the sensor 96, it is permissible to continue the conveyance or processing of a recording material in the downstream of the error detection position and stop conveyance of the recording material existing in the upstream of the error position.

According to this embodiment, as described above, even if an error occurs in the fixing apparatus or the image forming apparatus, the recording material P before cooling is not left on the fixing belt 56. Thus, removal of the recording material P is facilitated and damage of the fixing belt 56 or contamination of the fixing belt 56 by resin of recording material can be prevented.

Although the embodiment of the present invention has been described specifically, the present invention is not restricted to the above-described embodiments but may be modified in various ways based on the technical spirit of the invention. For example, the materials mentioned in the above embodiment are only an example and other material may be used as required.

In the above-described embodiment, the sensor 96 is used to detect the position of the recording material P in step S706. However, the present invention is not restricted to this example. If any recording material exists on the fixing belt 56, the CPU 401 may control driving of the fixing belt 56 or the conveyance roller 77 to stop the conveyance of the recording material after the recording material on the fixing belt 56 is conveyed to the position in which the recording material is cooled by the cooling fan 55. For example, the position of the recording material may be deterred from a timing in which registration of the resist roller pair 63 turns on instead of detection of the recording material by the sensor 96 in step S706. That is, the CPU 401 may control to stop the recording material when a predetermined time elapses since the rotation of the resist roller pair 63 starts, so that the recording material is conveyed to a position in which it is cooled by the cooling fan. Further, the recording material P may be detected based on a timing when a predetermined time elapses since when it is detected by photo sensors for detecting the other positions of the recording material P.

If an error occurs in conveyance of the recording material and the CPU 401 determines that the recording material exists on the fixing belt 56, the CPU 401 may control to increase the cooling intensity of the cooling fan 55. For example, the rotation number of the cooling fan 55 is controlled by the CPU 401 to change the cooling intensity of the cooling fan 55. Then, the cooling intensity of the cooling fan 55 is increased when the CPU 401 controls the rotation number of the cooling fan 55, so as to accelerate the rotation speed of the cooling fan 55.

Although this embodiment has been described about a case where the jammed first sheet P1 is in the lowest downstream, any method of stopping the conveyance at the same time when an error is detected or discharging to the discharge tray 51*b* may be adopted for sheets located in the downstream of the first sheet P1.

What is claimed is:

1. A fixing apparatus comprising:

a fixing rotary body;

a rotary body provided with an interval from the fixing rotary body;

an endless belt rotating in a condition in which it is wound around the fixing rotary body and the rotary body;

a pressure rotary body which makes a pressure contact with the fixing roller across the endless belt;

a heater for heating a recording material conveyed by the endless belt;

a cooling unit for cooling a recording material conveyed by the endless belt and heated by the heater; and an error detecting means for detecting an error in conveyance of the recording material, wherein when an error is detected in the downstream of the cooling unit by the error detecting means, the recording material is stopped after the recording material on the endless belt is conveyed to a position in which the cooling unit cools the recording material.

2. The fixing apparatus according to claim 1, wherein the cooling unit is so constructed to be capable of changing the cooling intensity and when an error is detected by the error detecting means, the cooling intensity by the cooling means is increased.

3. The fixing apparatus according to claim 1, further comprising a position detecting means so constructed to be capable of detecting a conveyance position of the recording material, wherein whether or not any recording material is located in the upstream of the cooling unit on the endless belt is detected by the position detecting means.

4. The fixing apparatus according to claim 1, further comprising a sensor provided in the downstream of the cooling unit for detecting a recording material, wherein when an error is detected by the error detecting means, the conveyance of the recording material is stopped after its is detected that the recording material on the endless belt is conveyed to a position in which the cooling unit cools the recording material by the sensor.

5. The fixing apparatus according to claim 1, wherein if the recording material is left on the fixing rotary body when the fixing apparatus is powered on, the recording material is conveyed to a position in which the recording material is cooled by the cooling unit.

6. A fixing apparatus comprising:

a fixing rotary body;

a rotary body provided with a predetermined interval from the fixing rotary body;

an endless belt rotating in a condition in which it is wound around the fixing rotary body and the rotary body;

a pressure roller which makes a pressure contact with the fixing rotary body across the endless belt;

a heater for heating a recording material conveyed by the endless belt;

a cooling unit for cooling a recording material conveyed by the endless belt and heated by the heater; and an error detecting means for detecting an error in conveyance of the recording material, wherein if an error is detected in the downstream of the cooling unit by the error detecting means, the fixing apparatus is stopped after the recording material on the endless belt is cooled by the cooling unit.

* * * * *